United States Patent [19]

Golan et al.

[11] 4,048,799

[45] Sept. 20, 1977

[54] WINCH CONTROL

[75] Inventors: Kenneth F. Golan, Pekin; James E. Winzeler, East Peoria, both of Ill.

[73] Assignee: Caterpillar Tractor Co., Peoria, Ill.

[21] Appl. No.: 742,966

[22] Filed: Nov. 17, 1976

[51] Int. Cl.[2] ..... F15B 1/02; F15B 11/16

[52] U.S. Cl. ..... 60/413; 60/422; 60/484; 60/905; 91/413; 74/471 R

[58] Field of Search ..... 91/413; 74/471 R, 480 R; 60/905, 484, 413, 422; 254/150 R

[56] References Cited

U.S. PATENT DOCUMENTS

| | | | |
|---|---|---|---|
| 2,775,429 | 12/1956 | Ashton | 91/413 X |
| 2,983,101 | 5/1961 | Tyler | 60/464 X |
| 3,519,247 | 7/1970 | Christison | 254/150 |
| 3,685,290 | 8/1972 | Kruschg | 60/905 X |

*Primary Examiner*—Edgar W. Geoghegan
*Attorney, Agent, or Firm*—Wegner, Stellman, McCord, Wiles & Wood

[57] ABSTRACT

A control for a hydraulically operated winch or the like having a hydraulically disengaged brake, a multi-speed, hydraulically controlled transmission, and a drum to be driven or braked. The control system includes means whereby the transmission is placed in neutral, automatically, whenever the brake is to be disengaged to lower a load and a control valve including a spool with small and large slots along with a drum-driven metering pump controls fast and slow lowering speeds. Emergency free fall of the load is accomplished in the valve by bypassing the small metering slot. An arrangement of an accumulator and check valves allow hydraulic disengagement of the brake even if the engine is dead and there is provided a recirculating hydraulic circuit to conserve oil in such an instance so that the accumulator volume can be minimized. A system is included whereby the accumulator may be discharged, when the prime mover is inoperative to allow the operator of the winch to leave the location with the load suspended with the knowledge that the load cannot be lowered either intentionally or accidentally.

8 Claims, 3 Drawing Figures

Fig. 3

TO MOTOR SPEED DIRECTION CONTROL
CONTROL
HI
LO
ACCUM.
BRK.
VEHICLE COMPONENTS
PRIORTY VALVE 10
12
14
16
18
20
22
24
26
28
30
32
34
36
38
40
42
44
46
48
50
52
54
56
58
60
62
64
100
122
156
160
162

WINCH CONTROL

BACKGROUND OF THE INVENTION

This invention relates to controls for hydraulically operated winches or the like.

Prior art of possible relevance includes U.S. Pat. No. 3,519,247 to Christison.

Winches are used in a large variety of operations and, as a consequence, there are winch constructions available with widely varying degrees of sophisticated control and drive equipment. Some of the more sophisticated winch constructions are hydraulically operated and include a hydraulic motor for driving a winch drum. Typically, there is provided a hydraulically disengaged brake which brakes the drum to prevent unduly rapid lowering of a load to be hoisted by the winch, and also multiple-speed, hydraulically controlled transmissions interconnect the drum and the drive motor therefor.

In such constructions, it is highly desirable to provide a means for regulating the amount of control fluid applied to the hydraulically disengaged brake to control the degree of disengagement of such brake and thereby control the rate of descent of an elevated load. It is also desirable that means be provided whereby a load hoisted by the winch can be lowered even when the prime mover for the hydraulic pump providing fluid under pressure for the winch system is inoperative.

Moreover, it is desirable that any such means employed to enable lowering of the load when the prime mover is inoperative can be selectively disabled to prevent inadvertent or intentional lowering of the load when the winch operator is away from the operating station.

Finally, it is desirable that manual controls for the system be made as simple and as foolproof as possible.

SUMMARY OF THE INVENTION

It is the principal object of the invention to provide a new and improved control for a hydraulically operated winch or the like having a hydraulically disengaged brake, a multi-speed, hydraulically controlled transmission, and a drum to be driven or braked.

An exemplary embodiment of the invention, according to one feature thereof, achieves the foregoing objects in a combination including a brake control valve having an inlet, an outlet, and selectively variable metering valve means between the inlet and the outlet. A metering pump is adapted to be operatively associated with the winch drum so as to be driven thereby. A first fluid conduit extends from the outlet valve to the metering pump and there is provided a port in the conduit which is adapted to be coupled to a hydraulically disengaged brake for the winch. A second fluid conduit extends from the metering pump to the inlet and a source of fluid under pressure connected to the inlet provides fluid for the system. The use of a metering valve in the system considerably simplifies the means required for controlling the degree of disengagement of the brake.

According to another feature of the invention, an accumulator is interconnected between the source and the inlet side of the valve and a check valve is located between the accumulator and the source to prevent fluid flow from the accumulator to the source. When the prime mover for the source of the fluid under pressure is inoperative, fluid under pressure stored in the accumulator may be utilized to selectively disengage the brake.

An exemplary embodiment of the invention, in another feature thereof, achieves the foregoing objects in a structure further including a transmission control valve having an inlet, at least two outlets, each adapted to be connected to a hydraulically controlled winch transmission of the multi-speed variety, and a valve member which is movable to allow a fluid flow from the inlet to a selected one or more of the outlets to select a desired transmission speed and to preclude fluid flow to any outlet to place the transmission in neutral. A brake control valve, of the general type mentioned previously, is provided and means, including a single manual actuator for the valve members, are provided to shift the valve members such that the transmission will be in neutral whenever the brake control valve is metering fluid flow to release the brake. In a highly preferred embodiment, the valve members are spools and the valves include a common housing for the spools.

The invention also contemplates the provision of a simplified control valve for a hydraulically disengaged brake including a valve housing, a bore in the housing, and a spool in the bore. An inlet extends to the bore and is adapted to be connected to a source of fluid under pressure. The bore includes a first outlet adapted to be connected to a fluid reservoir and a second outlet adapted to be connected to a hydraulically disengaged brake and located between the inlet and the first outlet. Lands are provided on the spool for alternatively precluding fluid flow from the inlet to the second outlet while allowing fluid flow between the outlets in one spool position and for interrupting fluid flow between the outlets while allowing fluid flow from the inlet to the second outlet in another spool position. The land means includes a first, relatively long, axial groove having a relatively small cross section in its periphery and which opens to the inlet side of the land means, the first groove having a progressively decreasing cross section from the inlet side. The land means also includes a second, relatively short groove having a relatively large cross section and opening to the inlet side of the land means. The first groove serves to meter fluid flow to provide excellent control of the degree of disengagement of the hydraulically disengaged brake while the second groove serves to allow fluid flow in such a way as to functionally bypass the first groove to allow fast lowering of light loads. When the control valve is utilized in a winch construction, the spool may be shifted further to allow fluid flow to bypass both grooves to allow free fall of the load in an emergency situation.

Other objects and advantages will become apparent from the following specification taken in connection with the accompanying drawings.

DESCRIPTION OF THE PREFERRED EMBODIMENT

Figures 1, 3:
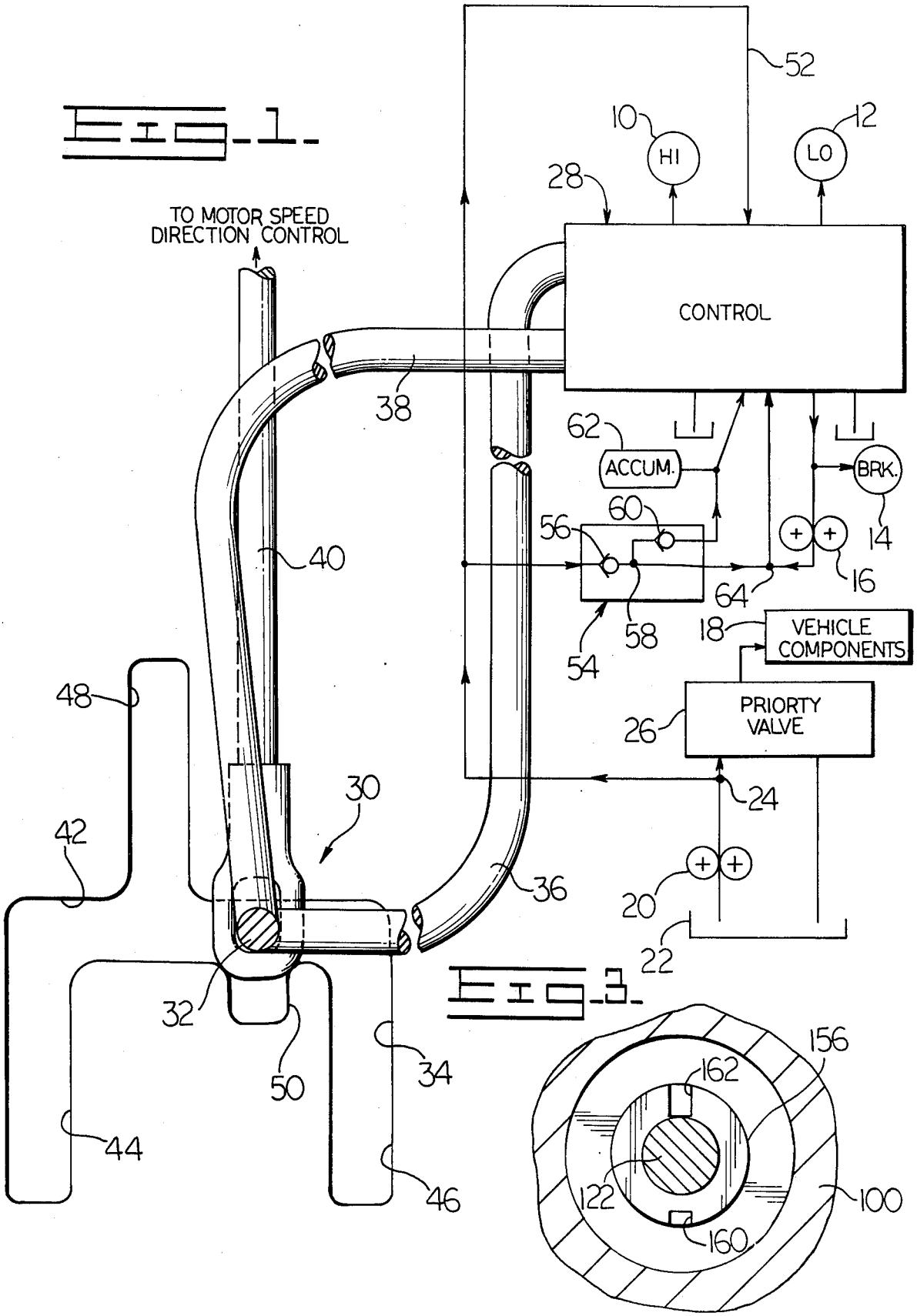
FIG. 1 is a schematic of a hydraulic control system made according to the invention and illustrating mechanical details of manual actuators therefor.
FIG. 3 is a sectional view taken approximately along the line 3—3 of FIG. 2.

An exemplary embodiment of a control system for a hydraulically operated winch or the like including a hydraulically disengaged brake, a multi-speed, hydraulically controlled transmission and a drum to be driven or braked is illustrated in the drawings and with reference to FIG. 1, is seen to include a multi-speed, hydraulically controlled transmission including a high speed section shown schematically at 10 and a low speed section schematically illustrated at 12. As will be seen, the transmission including the components 10 and 12 will be of the type that when fluid under pressure is directed to the high speed section 10 alone, the output speed of the transmission will be in high gear while when fluid under pressure is directed to both the high speed and low speed sections 10 and 12, the output speed of the transmission will be in the low range.

The usual winch assemblage will include a spring-engaged, hydraulically disengaged brake which may be of conventional construction and which is illustrated schematically at 14. The system will also include a metering pump 16 which will be suitably coupled to the winch drum through a one-way clutch (not shown) so as to be driven thereby when the load is lowered at a speed proportional to the rate of rotation of the winch drum. The purpose of the metering pump 16 will be described in greater detail hereinafter.

When the winch system is used in a vehicle as, for example, a pipe layer, there will be a number of additional hydraulically controlled components associated with the vehicle, which components are schematically illustrated at 18 and may include power steering and vehicle brake elements. Fluid under pressure is provided the system by a hydraulic pump 20, typically driven by the prime mover of the vehicle. The pump 20 receives oil from a reservoir 22 and directs the same, under pressure, to a junction 24. One side of the junction 24 extends to a priority valve 26 which, in turn, permits the flow of fluid to the vehicle components 18. The other side of the junction 24 extends to the control system of the present invention.

The priority valve 26 is of conventional construction and is operative to ensure delivery of fluid to the control system of the present invention at a pressure equal to or exceeding a predetermined minimum pressure. Frequently, hydraulic fluid flow requirements of the vehicle components 18 will cause the pressure to drop to a relatively low value which is insufficient to maintain engagement of the components of the transmission. The priority valve 26 prevents such from occurring.

The control system of the present invention includes a control valve, generally designated 28, which comprises two valves in a common housing. Manual actuators, generally designated 30, are provided for the valve 28 in, for example, an operator area. The manual actuators 30 include, for example, a handle 32 which may be grasped by the operator to perform a variety of functions to be described. A console within the operator is provided with a slot 34 in which the handle 32 may be moved.

A first mechanical link, shown schematically at 36, is attached to the handle 32 and extends to the control valve 28 to convey thereto mechanical motion of the handle 32 directing the selection of a particular transmission output speed. A similar linkage, shown schematically at 38, extends to a brake control section of the valve 28 to convey mechanical movement of the handle 32 to the valve 28 to direct the flow of hydraulic fluid under pressure to the brake 14 to control its degree of disengagement.

A third linkage, shown schematically at 40, extends to a motor speed and direction control system (not shown) which is operative to control the speed of the hydraulic drive motor for the winch as well as its directional output.

The linkages 36, 38 and 40 may be conventional in nature and, for example, in the form of control cables or linkages. It is only necessary that the linkage 36 be responsive to movement of the handle 32 in the right-left direction, as viewed in FIG. 1 and nonresponsive to other directions of movement thereof. The linkages 38 and 40 are similar, but are responsive only to up-down movement of the handle 32, as viewed in FIG. 1, and nonresponsive to left-right movement.

The slot 34 defines a shift pattern for the handle 32. It includes a horizontally elongated slot 42. When, as viewed in FIG. 1, the handle 32 is disposed in the left-hand end of the slot 42, the control valve 28 will direct the transmission to select its high speed output while, when the handle is in the right-hand extremity of the slot 42, it will direct the control valve 28 to select the low speed range of the transmission.

At each end of the slot 42, there are provided downwardly extending slots 44 and 46. When the handle 32 is aligned with either of the slots 42 and 46, and depressed therein, the linkage 40 will direct the motor speed and direction control system to drive the drum of the winch to elevate the load. The degree of depression of the handle 32 in either of the slots 44 and 46 will control the speed of the drive motor for the winch.

Also included is an upwardly extending slot 48 intermediate the ends of the slot 42. When the handle 32 is aligned with the slot 48, a direction by the valve 28 to the transmission will cause the latter to assume a neutral condition. As the handle 32 is elevated in the slot 48, the linkage 40 may be directed, at a particular point in time, to drive the drum motor in a direction to lower the load at a particular speed. At the same time, the brake 14 will be progressively disengaged as the handle 32 is raised in the slot 48.

A short, downwardly extending slot 50 intersects the slot 42 intermediate its ends. When the handle 32 is directed downwardly into the slot 50, there will be a direction to the motor speed and direction control system to energize the drive motor for the winch.

Whenever the handle 32 is alignedwith either of the slots 48 and 50 or in between the two, the transmission will be directed, by the valve 28 to remain in neutral. Thus, the use of the slot 50 enables the energization of the drive motor for the winch while the transmission is in neutral to enable warmup of the components without changing the position of the load carried by the winch. This feature of the invention, when used, ensures excellent response of the system in cold environments.

Returning to the junction 24, hydraulic fluid under pressure is directed along a line 52 to the transmission control side of the valve 28 in a manner to be described in greater detail hereinafter. It is also directed to a check valve system 54. The check valve system 54 includes a first check valve 56 which precludes backflow from any downstream component to the junction 24. Just downstream of the check valve 56 there is located a junction 58. Connected to the junction 58 is a check valve 60 which extends to an accumulator 62 and to the control valve 28 in a manner to be described. The check valve 60 precludes discharge of the accumulator except through the valve 28.

The junction 58 is also tapped to a junction 64 which is common with the outlet side of the metering pump 16 and extends to the valve 28.

Figure 2:
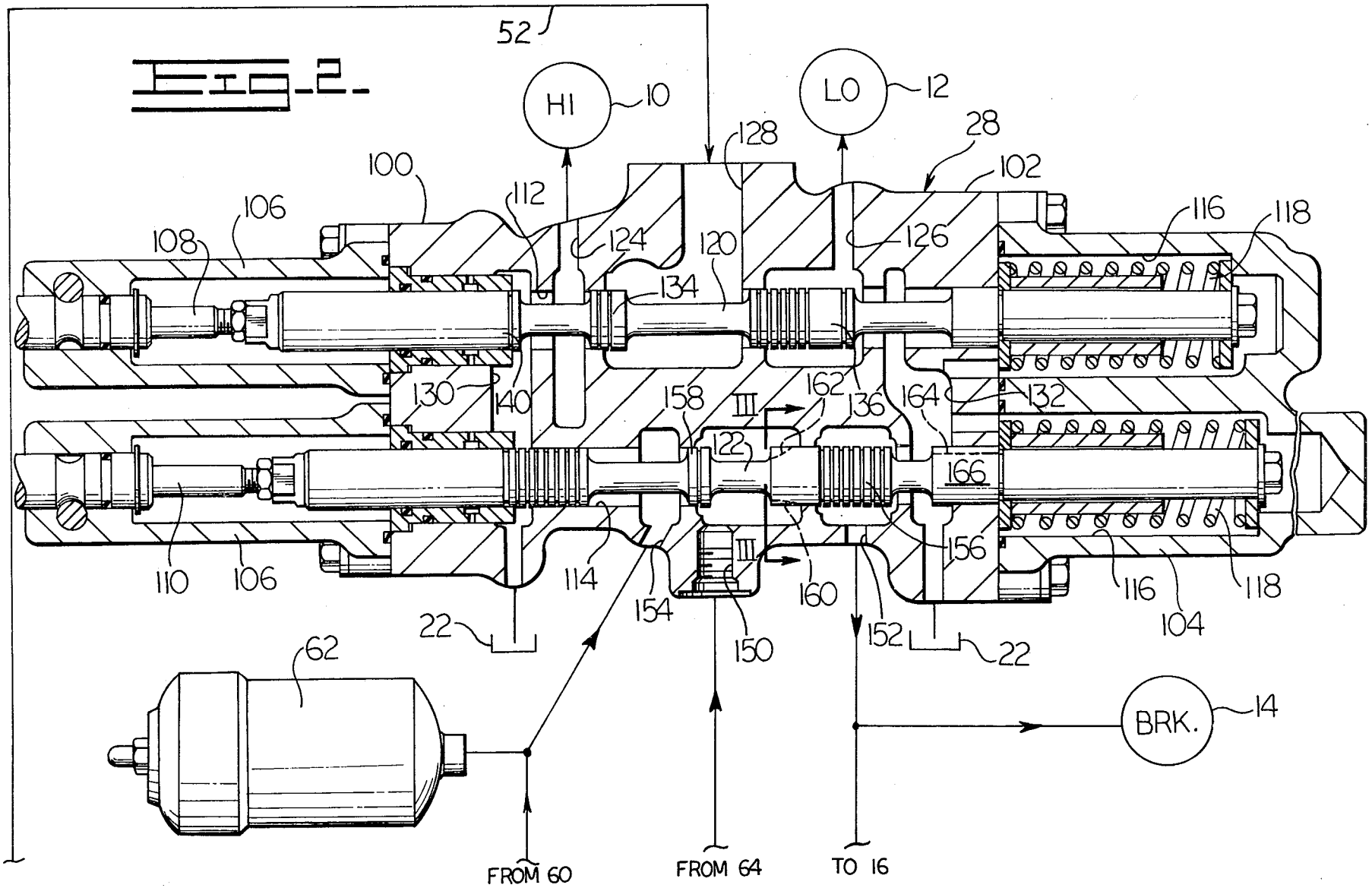
FIG. 2 is a sectional view of a control valve embodied in the invention which also schematically illustrates peripheral components utilized in the system.

Turning now to FIGS. 2 and 3, the construction of the control valve 28 will be described in greater detail. The valve 28 includes a housing 100 formed of a center housing 102 a right end housing 104 and two left end housings 106. The end housings 106 receive, in a conventional fashion, cable ends 108 and 110 of the linkages 36 and 38, respectively. The center housing 100 includes a transmission control bore 112 and a brake control bore 114. The housing 104 includes cavities 116 which are aligned with the bores 112 and 114 and house bi-directional spring centering assemblies 118 which are operative to center respective ones of a transmission control spool 120 in the bore 112 and a brake control spool 122 in the bore 114 to the positions illustrated in FIG. 2 regardless of whether the spools 120 and 122 are shifted to the right or to the left.

The spools 120 and 122 have leftward extensions which extend into respective ones of the housings 106 for connection to the cable ends 108 and 110 whereby the spools 120 and 122 may be shifted to the right or to the left in their bores by manipulation of the handle 32, as mentioned previously.

The transmission control bore 112 includes a first outlet port 124 which may be connected to the high section 10 of the transmission to be controlled and a second outlet port 126 which may be connected to the low section 12 of the transmission. Intermediate the outlet ports 124 and 126 is an inlet port 128 which is connected to the junction 24 (FIG. 1). On the sides of the outlet ports 124 and 125 opposite from the inlet port 128, the bore 112 is provided with drain ports 130 and 132, respectively, which drain ports are also common to the brake control bore 114 and which are connected to the reservoir 22.

The spool 120 includes spaced lands 134 and 136. Dependent upon the position of the spool 120 within the bore 112, the land 134 will either preclude fluid communication between the ports 124 and 128 or the ports 124 and 130. The land 136 will either preclude fluid communication between the ports 126 and 128 or the ports 126 and 132. In the position of the valve illustrated in FIG. 2, which corresponds to a position directing the transmission to be in neutral, the lands 134 and 136 block the flow of pressurized fluid into either the transmission sections 10 and 12, while at the same time allow fluid flow from those sections to the reservoir 22 through the drain ports 130 and 132 respectively.

To command the transmission to operate in its low range, the handle 32 is moved to the right in the slot 42, as mentioned previously. This will cause a commensurate shift of the spool 120 to the right within the bore 112. This, in turn, will establish fluid communication between the inlet 128 and both of the outlets 124 and 126. Flow to drain through the port 132 is blocked by the right-hand side of the land 136 in such a case, while flow to drain through the port 130 is blocked by an enlarged end 140 which will move into a position blocking fluid flow between the outlet port 124 and the drain port 130.

Conversely, when the handle 32 is shifted to the left, as viewed in FIG. 1, to direct the transmission to operate in its high range, the spool 120 will shift to the left within the bore 112 from the position shown. At this time, the land 134 will shift to the left to preclude fluid communication between the port 124 and the drain port 130 while enabling fluid flow from the inlet port 128 to the port 124. The rather long axial length of the land 136 will continue to block the flow of the fluid to the outlet port 126. As a consequence, for the type of transmission alluded to previously wherein low range is commanded by the direction of hydraulic fluid to both the high and low sections 10 and 12, and wherein high range is commanded by the direction of hydraulic fluid to the high section 10 alone, the spool 120 in response to manual shifting, directs fluid flow appropriately.

Turning now to the brake control section of the valve 28, the brake control bore 114 includes an inlet port 150 which is connected to the junction 64 (FIG. 1) for receipt of fluid under pressure. Just to the right of the inlet port 150 as seen in FIG. 2, is an outlet port 152 which is adapted to be connected to both the brake 14 of the winch and to the metering pump 16. The outlet port 152 is disposed between the inlet port 150 and the outlet port 132 which extends to the reservoir 22.

Disposed between the drain port 130 and the inlet port 150 is an additional inlet port 154 to the bore 114. The port 154 is connected to the accumulator 62.

The spool 122 includes a land 156 having a relatively long axial length which is normally operative to preclude the flow of fluid from the inlet 150 to the outlet port 152 while allowing flow of fluid from the outlet port 152 to drain through the drain port 132 or to interrupt fluid communication between the drain port 132 and the outlet port 152 and allow fluid to flow from the inlet port 150 to the outlet port 152 under circumstances to be described in greater detail hereinafter.

A relatively short land 158 is also carried by the spool 122 and is operative, in essentially only one position of the spool 122, namely that shown, to block fluid communication between the inlet ports 150 and 154.

As seen in FIGS. 2 and 3, the land 156 includes oppositely disposed, axially extending grooves 160 and 162 in its periphery. Each of the grooves 160 and 162 opens to the inlet side of the land 156 and, as can be best seen in FIG. 2, the groove 160 has a relatively long axial length, while the groove 162 has a relatively short axial length. As seen in FIG. 3, the groove 162 has a relatively large cross section, while the groove 160 has a relatively small cross section. Moreover, both of the grooves have a progressively decreasing cross section from left to right.

In the case of a brake in a winch, it is desired that there be an infinite number of degrees of disengagement so that the speed of descent of the load can be regulated. The groove 160 serves as a metering groove to assist in attaining such a degree of brake disengagement control. Specifically, the further the spool 122 is moved to the right, as viewed in FIG. 2, the greater the fluid flow from the inlet 150 to the outlet 152 through the groove 160. The greater the fluid flow, the greater the degree of disengagement of the brake 14 which, it will be recalled, is of the hydraulically disengaged type. For even greater rightward shifts of the spool 122 within the bore 114, fluid communication between the ports 150 and 152 will be established through the larger groove 162 so that fluid flow will be less restricted. Full rightward spool travel bypasses both grooves to thereby cause full disengagement of the brake 14, enabling rapid lowering of the load, a highly desirable feature in emergency situations.

In normal operation, fluid being directed to the brake 14 to disengage the same will be pumped away from the brake 14 at a predetermined rate by the metering pump 16. The rate at which such occurs will be dependent upon the rate of rotation of the winch drum which drives the metering pump 16. Thus, the metering pump serves as a governor for the selected degree of brake disengagement and the rate at which a load will be lowered.

It will be observed from FIG. 1 that the output of the metering pump 16 is returned to the supply from the pressure source at the junction 64 as opposed to the reservoir 22. This feature of the invention minimizes the amount of hydraulic fluid required to cause disengagement of the brake 14 and is particularly advantageous when the pump 20 is inoperative as, for example, when the prime mover therefor is inoperative.

Those skilled in the art will recognize from the foregoing description that operation of the pump 20 will cause the loading of the accumulator 62 through the flow path previously indicated. When fluid flow into the port 150 is cut off by reason of an inoperative pump 20, the brake 14 may nonetheless be disengaged by the shifting of the spool 122 to the right, as viewed in FIG. 2, by reason of the supply of fluid under pressure contained in the accumulator 62. Such fluid flow will be allowed by movement of the land 158 to the right and the flow will pass to the outlet 152 via the slot 160 or the slot 162, or both. Such fluid cannot exit via the inlet 150 by reason of the provision of the check valve 56. Consequently, by reason of the recirculation of the fluid from the metering pump in a closed system, accumulator volume is minimized, allowing the use of a smaller accumulator.

The system also includes means whereby the accumulator 62 may be discharged to prevent inadvertent or unauthorized, but intentional, disengagement of the brake 14 when the pump 20 is inoperative which would cause lowering of a load. In particular, it is only necessary to move the handle 32 downwardly in either the slot 46 or 44. This will cause a shifting of the spool 122 to the left, as viewed in FIG. 2, such that the land 158 will allow fluid flow from the port 154 to the port 150. The fluid from the accumulator 62 will then flow to the junction 64 and leak through the metering pump 116 at a low pressure insufficient to disengage the brake 14 to enter the port 152 and pass through slot 164 of land 166 to the drain conduit 132. The fluid will ultimately then be discharged into the reservoir 22 to exhaust the accumulator 62.

From the foregoing, it will be seen that a control system made according to the invention achieves a variety of the objects mentioned previously. The configuration of the selection mechanism 30 ensures that the transmission will be in a neutral condition whenever the brake is released. It also provides for intentional and authorized disengagement of the brake 14 when the primary motive source is inoperative and provides means whereby unintentional or unauthorized intentional releasing of the brake 14 can be prevented. Moreover, the unique configuration of the grooves in the brake control valve provides a simple means for controlling the rate of fluid flow to the brake, as well as provides means whereby rapid lowering can occur in an emergency situation. The manual controls are simple and easy to operate and the use of a single housing common to both the transmission control valve and the brake control valve simplifies installation of the system.

What is claimed is:

1. In a control for a hydraulically operated winch or the like having a hydraulically disengaged brake, and a multispeed, hydraulically controlled transmission and a drum to be driven or braked, the combination of:

a brake control valve having an inlet, an outlet and selectively variable metering valve means between said inlet and outlet;

a metering pump adapted to be operatively associated with a winch drum so as to be driven thereby;

a first fluid conduit extending from said outlet to said metering pump;

a port in said first fluid conduit adapted to be coupled to said hydraulically disengaged brake for the winch;

a second fluid conduit extending from said metering pump to said inlet; and a source of fluid under pressure connected to said inlet.

2. The control of claim 1 further including an accumulator interconnected between said source and the inlet side of said valve means and a check valve located between said accumulator and said source to prevent fluid flow from the accumulator to said source.

3. In a control for a hydraulically operated winch or the like having a hydraulically disengaged brake, and a multispeed, hydraulically controlled transmission and a drum to be driven or braked, the combination of:

a brake control valve including first and second inlets and an outlet adapted to be connected to said hydraulically disengaged brake, a movable valve member for metering fluid flow from either inlet to said outlet, and valve means normally interrupting fluid communication between said inlets;

a source of fluid under pressure connected to said first inlet;

an accumulator connected to said second inlet; and a fluid conduit, including a check valve, extending from said source to said accumulator.

4. In a control for a hydraulically operated winch or the like having a hydraulically disengaged brake, and a multispeed, hydraulically controlled transmission and a drum to be driven or braked, the combination of:

a transmission control valve having an inlet, at least two outlets, each adapted to be connected to a hydraulically controlled winch transmission, and a movable valve member for allowing fluid flow from said inlet to a selected one or more of the outlest to select a desired transmission speed and to preclude fluid flow to any outlet to place the transmission in neutral;

a brake control valve having an inlet, an outlet adapted to be connected to said hydraulically disengaged brake for a winch, and a movable valve member for metering fluid flow from said inlet to said outlet; and means including a single manual actuator for said valve member such that said transmission control valve member will preclude fluid flow to place the transmission in neutral whenever said brake control valve member is metering fluid flow to release the brake.

5. The control of claim 4 wherein said valve members are spools and said valves include a common housing for said spools.

6. In a control valve for a hydraulically disengaged brake or the like, the combination of:

a valve housing;

a bore in said housing;

a spool in said bore;

an inlet to said bore and adapted to be connected to a source of fluid under pressure;

a first outlet from said bore adapted to be connected to a fluid reservoir;

a second outlet from said bore adapted to be connected to a brake and being located between said inlet and said first outlet; and land means on said spool for alternately (a) precluding fluid flow from said inlet to said second outlet while allowing fluid flow between said outlets and in one spool position, (b) interrupting fluid flow between said outlets while allowing fluid flow from said inlet to said second outlet in another spool position;

said land means including a first, relatively long, axial groove having a relatively small cross section in its periphery and opening to the inlet side of said land means, said first groove having a progressively decreasing cross section from said inlet side;

said land means further including a second, relatively short axial groove having a relatively large cross section and opening to the inlet side of said land means;

said second groove, when allowing fluid flow from said inlet to said second outlet, serving to functionally bypass said first groove;

said spool being further shiftable within said bore so that both said first and second grooves are functionally bypassed.

7. The control valve of claim 6 further including an additional inlet to said bore adjacent to said first named inlet and oppositely of said second outlet, and adapted to be connected to an accumulator, an auxiliary source of fluid under pressure, or the like; and additional land means on said spool for precluding the flow of fluid between said inlets for said one position of said spool within said bore and allowing fluid flow between said inlets for all other positions of said spool within said bore.

8. The control valve of claim 7 wherein said first named land means and said additional land means, said inlets and said outlets are configured with respect to each other such that when said spool is shifted in a direction from said one position oppositely from said other position, fluid flow between said first named inlet and said second outlet will be blocked while when said spool is shifted from said one position to said other position, fluid flow between said inlets may occur.

* * * * *